US008220272B2

(12) United States Patent
Hall et al.

(10) Patent No.: US 8,220,272 B2
(45) Date of Patent: Jul. 17, 2012

(54) COMBUSTOR HOUSING FOR COMBUSTION OF LOW-BTU FUEL GASES AND METHODS OF MAKING AND USING THE SAME

(75) Inventors: Joel Meador Hall, Mauldin, SC (US); Sergey Adolfovich Oskin, Saint-Petersburg (RU); Scott Robert Simmons, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 775 days.

(21) Appl. No.: 12/328,346

(22) Filed: Dec. 4, 2008

(65) Prior Publication Data

US 2010/0139238 A1 Jun. 10, 2010

(51) Int. Cl.
*F02C 1/00* (2006.01)

(52) U.S. Cl. ..... 60/740; 60/39.463

(58) Field of Classification Search ..... 60/39.463, 60/737, 740, 742, 746, 747, 748, 796
See application file for complete search history.

(56) References Cited

U.S. PATENT DOCUMENTS

| | | | | |
|---|---|---|---|---|
| 4,253,301 | A | 3/1981 | Vogt | |
| 4,498,288 | A | 2/1985 | Vogt | |
| 4,833,878 | A * | 5/1989 | Sood et al. | 60/778 |
| 5,259,184 | A * | 11/1993 | Borkowicz et al. | 60/39.55 |
| 5,833,141 | A * | 11/1998 | Bechtel et al. | 239/406 |
| 5,873,237 | A * | 2/1999 | Medla et al. | 60/800 |
| 6,201,029 | B1 | 3/2001 | Waycuilis | |
| 6,945,051 | B2 * | 9/2005 | Benelli et al. | 60/737 |
| 7,134,287 | B2 * | 11/2006 | Belsom et al. | 60/800 |
| 2007/0151255 | A1 * | 7/2007 | Johnson et al. | 60/776 |
| 2007/0275337 | A1 | 11/2007 | Heilos et al. | |

FOREIGN PATENT DOCUMENTS

EP 0310327 A2 4/1989

* cited by examiner

*Primary Examiner* — Louis Casaregola
*Assistant Examiner* — Phutthiwat Wongwian
(74) *Attorney, Agent, or Firm* — Cantor Colburn LLP

(57) ABSTRACT

A combustor housing includes an inlet cover plate having a central inlet configured to receive a supply of one of a high BTU content fuel or air and at least one radially-spaced, peripheral fuel inlet configured to receive a supply of a low BTU content fuel. It also includes an outlet cover plate having at least one radially-spaced, peripheral fuel outlet. The combustor housing also includes a peripheral sidewall joining the inlet cover and the outlet cover and enclosing a plenum, the at least one peripheral fuel inlet opening through the inlet cover plate into the plenum and the at least one fuel outlet opening from the plenum through the outlet cover plate. The central inlet opens into at least one conduit which extends away from the central inlet and opens into at least one high BTU content fuel conduit or air supply conduit that is axially aligned with the at least one fuel outlet.

11 Claims, 7 Drawing Sheets

COMBUSTOR HOUSING FOR COMBUSTION OF LOW-BTU FUEL GASES AND METHODS OF MAKING AND USING THE SAME

BACKGROUND OF THE INVENTION

The subject matter disclosed herein relates to combustors for a high-temperature gas turbine engine, and more particularly, to combustor housings for use with fuel gas having a low BTU content.

Uncertainties in the cost and availability of petroleum-based fuels and natural gas, coupled with the desire to use all available fuel sources have resulted in commercial interest in the use of very low heating value gas fuels to power gas turbines. Various designs have been proposed for the use of low heating value gases, such as those having heating contents as low as 2500 BTU/lbm and have generally consisted of adaptations of existing combustor designs.

One example is U.S. Pat. No. 4,498,288 that describes a combustor design whereby a portion of a low-BTU gas fuel is injected through a traditional style fuel nozzle into a primary burning zone and the balance of the low-BTU gas fuel is injected through a secondary pipe into a main burning zone. This combustor design does not consider or accommodate the need for large flow areas upstream of combustion.

Another example, EP0310327A3 describes a combustor that is similar to that described in U.S. Pat. No. 4,498,288 above in that the balance of the low-BTU gas fuel is injected through a secondary passage. However, in this case, both the primary and secondary injection passages discharge into a single combustion zone. This combustor design also does not consider or accommodate the need for large flow areas upstream of combustion.

Still another example, U.S. Pat. No. 6,201,029 contains another approach to burning low-BTU content gas fuels that again involves downstream injection of a portion of the low-BTU content fuel gas. This combustor design also does not consider or accommodate the need for large flow areas upstream of combustion.

Still another example, US2007/0275337 describes a combustor in which a helical air swirler is modified to include fuel injection into the swirling air passages, and indicates that such injection is well-suited to the combustion of low-BTU synthesis gas and that such a burner can operate in pre-mixed or diffusion mode and can handle low or high levels of fuel heating value with different fuel injection circuits. The radial air passages are large relative to the conventional fuel passages, such that area is available for injection of low BTU gas. This combustor design also does not consider or accommodate the need for large flow areas upstream of combustion.

As the calorific value (BTU or energy content, or Lower Heating Value (LHV)) of gas fuels is reduced, the required flow rate increases. This leads to an increased pressure loss through passageways originally designed for fuels with higher energy content. This loss of pressure comes at a great price to the turbine cycle efficiency if the fuel compressor is driven by the gas turbine. This problem is exacerbated in fuel gases having a very low calorific value, such as those having a calorific value less than 2500 BTU/lbm. It is even further exacerbated as the number of separate inlets used for the very low energy content gas are increased to provide the amount of such gas necessary for combustion. Gas velocities through fuel flow passages may also be high, leading to increased heat transfer from the metal walls to the fuel gas, or vice versa. This can cause local thermal gradients within the combustor leading to increased cyclic thermal stresses and the possibility for degradation or failure of the various combustor components. The design, development, machining and other manufacturing processes employed to create multiple fuel flow passages into the combustor or combustion chamber adds complexity and cost to systems using multiple passages.

Therefore, it is desirable to reduce pressure losses associated with the use of very low content fuels so as to improve the system efficiency. It is also desirable to reduce gas velocity to reduce thermal gradients and associated thermal stresses, particularly where the fuel gas exits the combustor through the nozzle, since this is the high-temperature portion of the combustor. It is also desirable to simplify the combustor design, particularly as it relates to the incorporation of multiple fuel lines into the combustor to lower the complexity and cost of the combustor.

BRIEF DESCRIPTION OF THE INVENTION

According to one aspect of the invention, a combustor housing includes an inlet cover plate having a central inlet configured to receive a supply of one of a high BTU content fuel or air and at least one radially-spaced, peripheral fuel inlet configured to receive a supply of low BTU content fuel. It also includes an outlet cover plate having at least one radially-spaced, peripheral fuel outlet. The combustor housing also includes a peripheral sidewall joining the inlet cover and the outlet cover and enclosing a plenum, the at least one peripheral fuel inlet opening through the inlet cover plate into the plenum and the at least one fuel outlet opening from the plenum through the outlet cover plate. The central inlet opens into at least one conduit which extends away from the central inlet and opens into at least one high BTU fuel conduit or air supply conduit that is axially aligned with the at least one fuel outlet.

According to another aspect of the invention, a method of making a combustor housing includes providing an inlet cover plate having a central inlet configured to receive a supply of one of a high BTU content fuel or air, at least one radially-spaced peripheral fuel inlet configured to receive a supply of a low BTU content fuel, the inlet cover plate and an integral peripheral sidewall partially enclosing a plenum. The at least one peripheral fuel inlet opening through the inlet cover plate into the plenum. The central inlet opening into at least one conduit which extends away from the central inlet and opens into at least one high BTU content fuel conduit or air supply conduit. The method also includes providing an outlet cover plate having at least one radially-spaced, peripheral fuel outlet opening from the plenum through the outlet cover plate. Further, the method includes attaching the outlet cover plate to the peripheral sidewall to enclose the plenum, wherein the at least high BTU content fuel conduit or air supply conduit is axially aligned with the at least one fuel outlet.

According to yet another aspect of the invention, a method of making a combustor housing includes providing an outlet cover plate having at least one radially-spaced, peripheral fuel outlet and an integral peripheral sidewall partially enclosing a plenum. It also includes providing an inlet cover plate having a central inlet configured to receive a supply of one of a high BTU content fuel or air and at least one radially-spaced, peripheral fuel inlet configured to receive a supply of a low BTU content fuel, the at least one peripheral fuel inlet opening into the plenum, the central inlet opening into at least one conduit which extends away from the central inlet and opens into at least one high BTU fuel conduit or air supply conduit. The method also includes attaching the inlet cover plate to the peripheral sidewall to enclose the plenum, wherein the at least one high BTU fuel conduit or air supply conduit is axially aligned with the at least one fuel outlet, the fuel outlet opening from the plenum through the outlet cover plate.

According to yet another aspect of the invention, a method of using a combustor housing includes providing a combustor housing comprising an inlet cover plate having a central inlet configured to receive a supply of one of a high BTU content fuel or air and at least one radially-spaced, peripheral fuel inlet configured to receive a supply of a low BTU content fuel; an outlet cover plate having at least one radially-spaced, peripheral fuel outlet; and a peripheral sidewall joining the inlet cover plate and the outlet cover plate and enclosing a plenum, the at least one peripheral fuel inlet opening into the plenum and the at least one fuel outlet opening from the plenum through the outlet cover plate, the central inlet opening into at least one conduit which extends away from the central inlet and opens into at least one high BTU fuel conduit or air supply conduit that is axially aligned with the at least one fuel outlet. The method also includes providing a supply of gaseous fuel having BTU content of less than 2500 BTU/lbm to the at least one radially-spaced, peripheral fuel inlet, wherein the gaseous fuel enters the plenum and is distributed to the at least one radially-spaced, peripheral fuel outlet.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

Figure 1:
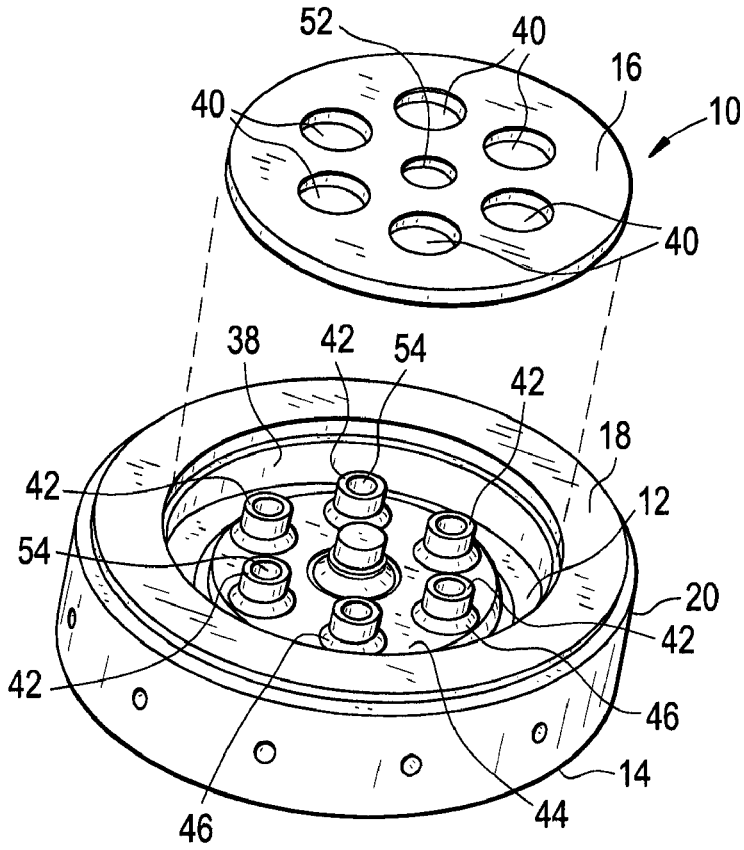
FIG. 1 is an exploded perspective view of an exemplary embodiment of a combustor housing as disclosed herein.

The detailed description explains embodiments of the invention, together with advantages and features, by way of example with reference to the drawings.

DETAILED DESCRIPTION OF THE INVENTION

A combustor designed to supply large quantities of very low BTU content gas fuel to a gas-turbine combustion system with minimal pressure loss, uniform distribution of the fuel gas, and improved material durability is disclosed. The combustor includes a combustor housing that houses a single fuel supply plenum adapted to receive fuel through multiple inlets from multiple fuel supply lines. The plenum is formed from a metal body that is configured to be connected to one or more fuel nozzles downstream and to one or more fuel supply pipes upstream. The exemplary embodiments disclosed include a cylindrical metal housing into which a gas manifold or plenum is formed within a peripheral sidewall and may include in a base portion thereof either of one or more fuel outlets or fuel inlets. This housing also includes a cover plate to which includes one or more fuel inlets or fuel outlets, respectively. The inlets is configured to receive one or more inlet supply pipes for delivery of low BTU content gas fuels and is particularly suited for use with very low BTU content fuels. The inlet side of the housing may also be configured to receive air as well as starting fuels of higher energy content. The very low BTU content gas fuels are delivered into the plenum and distributed thereby to one or more nozzles disposed over outlets on the outlet side of the combustor for delivery to and combustion in the combustion chamber. The air, starting fuels or both are passed through the center of the housing and into the nozzle for ignition of the very low BTU content fuel gas flowing through the nozzle.

The plenum is designed to provide a large flow area to create a low flow velocity of the very low BTU content fuel and to minimize the pressure loss at the combustor. The connection between the plenum and the downstream fuel nozzle(s) is designed so that a (360°) spacing, such as annular spacing, is provided from the plenum into each nozzle. The upstream or inlet side of the housing is designed such that an increased area is available for attachment of the fuel supply pipes. This combustor serves as the fuel inlet and combustion source for a gas turbine combustion system, which may operate on fuels with a large range of heating values, while minimizing pressure loss and non-uniformity of the gas flow, even at the very high gas flow rates required for use of a very low BTU content gas fuels. The combustors disclosed herein are suitable for use many gaseous fuels, including low BTU content fuels having a low BTU content down to about 2500 BTU/lbm, but is particularly suited for use with gaseous fuel having a very low BTU content less than 2500 BTU/lbm, and more particularly for fuels having a very low BTU content of about 800 to 1500 BTU/lbm, and even more particularly about 1000 BTU/lbm. The portions of the housing described herein may be sealably joined by various joining means, such as various welding processes or fastening means, such as a plurality of threaded bolts.

Figure 2:
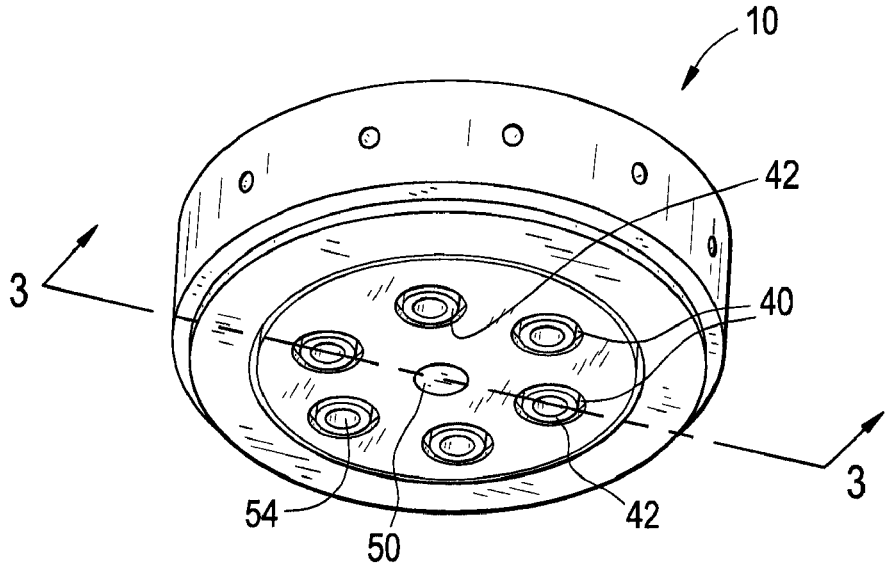
FIG. 2 is a perspective view of the assembled housing of FIG. 1.
Figure 3:
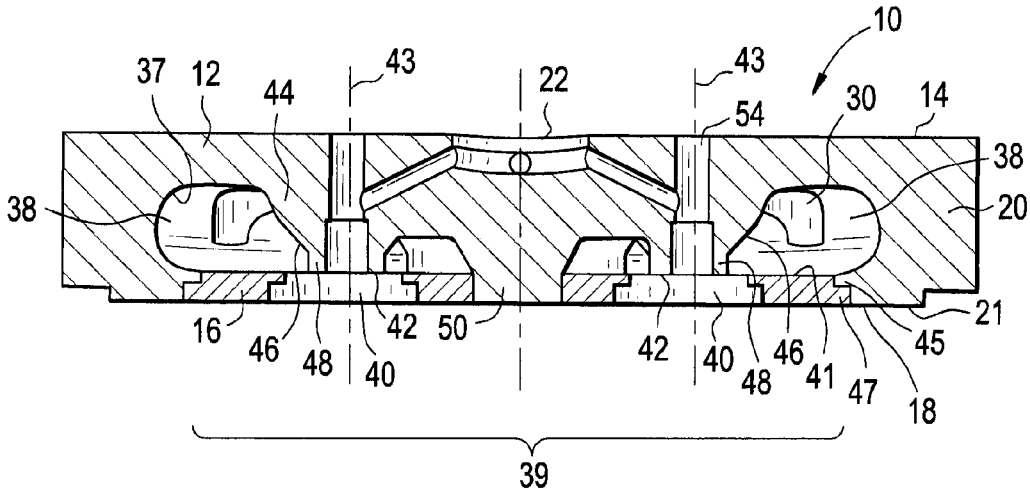
FIG. 3 is a cross-sectional view of the combustor housing of FIG. 2 taken along section 3-3.

Referring to FIGS. 1-3, a first exemplary embodiment of a combustor housing 10 is illustrated. The combustor housing 10 has an inlet cover plate 12 on an inlet side 14, an outlet cover plate 16 on an outlet side 18 and a peripheral sidewall 20. In this embodiment, inlet cover plate 12 and sidewall 20 are formed from an integral metal plate. The combustor housing 10 may have any suitable shape or size, and may be formed from any suitable high temperature material. In the embodiment of FIGS. 1-3, combustor housing 10 is in the shape of a cylinder having a diameter of between about 1.0-3.0 ft., and more particularly about 1.5 ft., and a thickness of about 4-5 inches. Combustor housing 10 may be made using any suitable material adapted to perform at operating temperatures of up to about 600° C., including various grades of steel, such as stainless steels, as well as various, Ni-based, Fe-based, Co-based and other high temperature metal alloys and materials. Forming of the integral inlet cover plate 12 and sidewall 20 may be performed using any suitable method, including the use of machining, grinding and the like.

Figure 7:
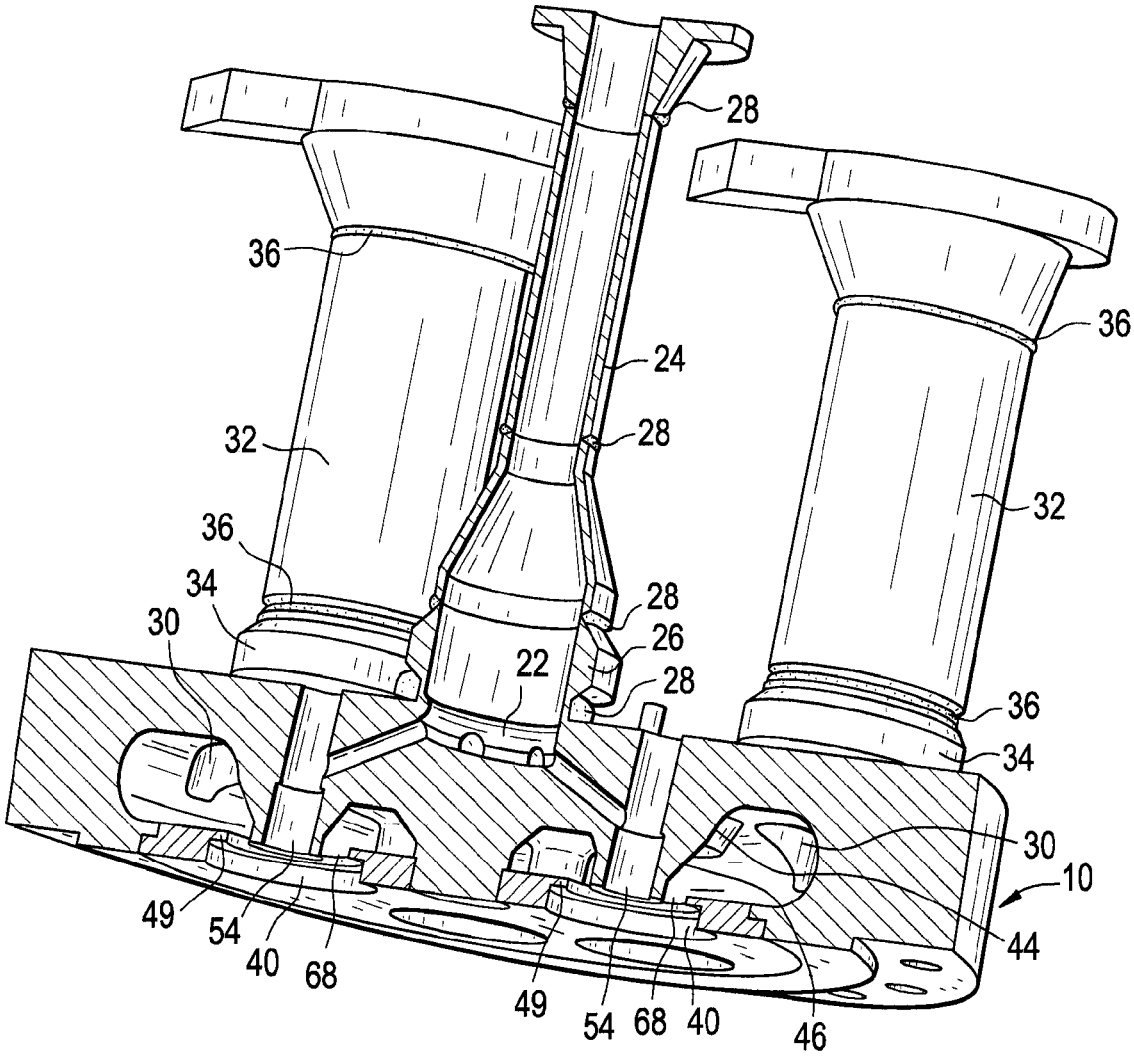
FIG. 7 is a perspective cross-sectional view of an exemplary embodiment of a partial combustor assembly as disclosed herein.
Figure 8:
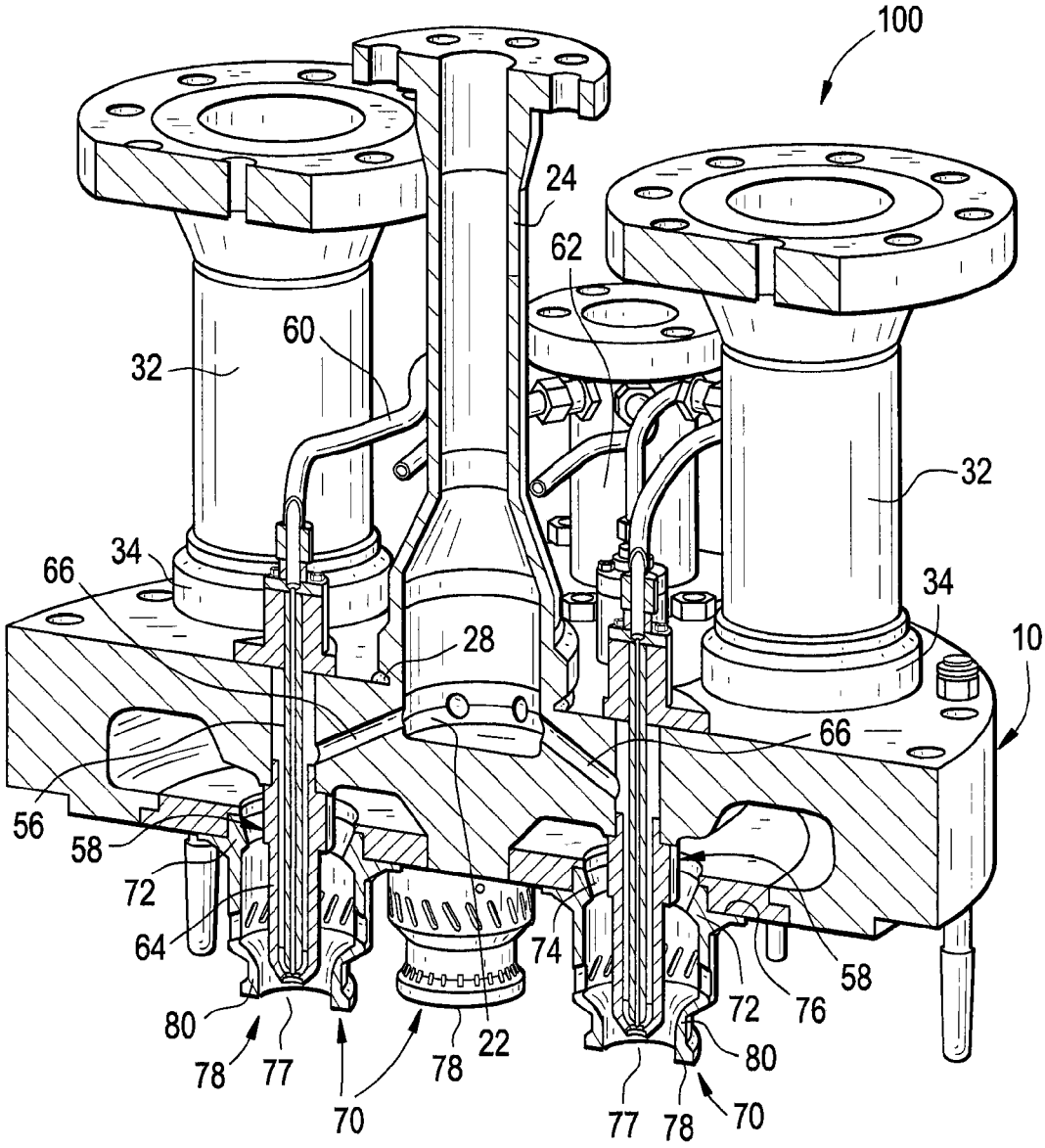
FIG. 8 is a perspective cross-sectional view of an exemplary embodiment of a combustor assembly as disclosed herein.
Figure 9:
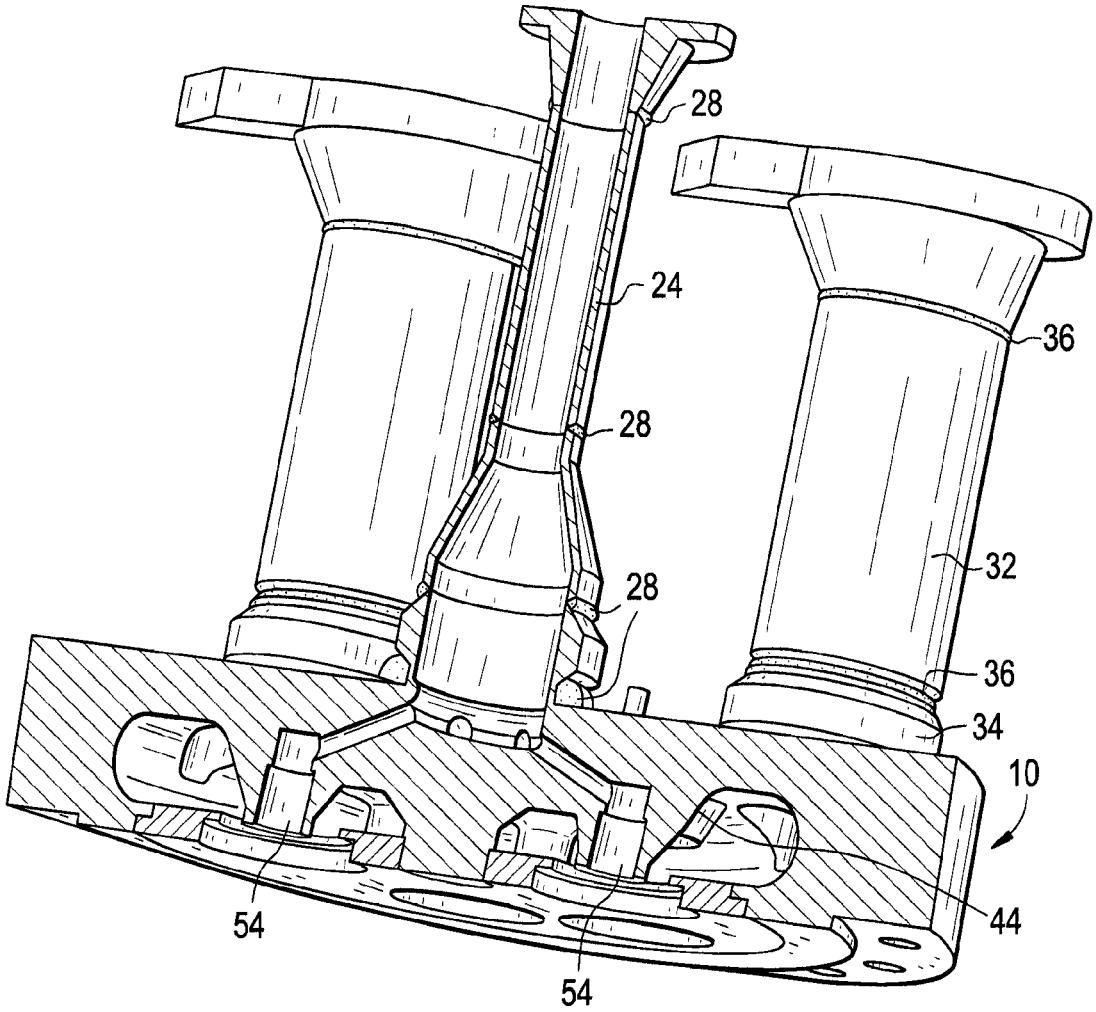
FIG. 9 is a perspective cross-sectional view of a second exemplary embodiment of a partial combustor assembly as disclosed herein.

As shown in FIGS. 3 and 7-10, the inlet cover plate 12 has a central inlet 22, preferably in the form of a cylindrical central bore, but with other inlet shapes also being possible. Central inlet 22 is configured to receive a supply of one of a relatively higher BTU content starting fuel or air through a supply pipe 24. Central inlet 22 may also have an attachment flange 26 disposed thereon for attachment of supply pipe 24, but may also include other suitable attachment means for attaching supply pipe 24 for the high BTU content fuel or air. Supply pipe 24 and attachment flange 26 may be attached by welds 28 as shown in FIG. 9, or by other suitable attachment means.

Inlet cover plate 12 also includes at least one radially-spaced, peripheral fuel inlet 30. Peripheral fuel inlet 30 may have any suitable shape or size. More particularly, fuel inlet 30 may have the form of a cylindrical inlet bore having a bore diameter, by way of a non-limiting example, of about 3-5 inches. As used herein, "radially-spaced" and "peripheral" should be broadly understood to indicate that the item referred to, in this case the at least one fuel inlet 30, is generally positioned away from the center of the object on which it is located, in this case the inlet cover plate 12, and that it is spaced radially with respect to other openings that may extend through the object in a similar manner. It is not limiting as to the distance from the center or the radial spacing with respect to, in the case of inlets, other inlets or openings, or, in the case of outlets, other outlets or openings. While one fuel inlet 30 may be included, inlet cover plate 12 is particularly well suited to include a plurality of fuel inlets 30, as shown in FIGS. 1-3, 7 and 8. Fuel inlet 30 is configured to receive a supply of low BTU content fuel through one or more low BTU content fuel supply pipe 32, as shown in FIGS. 7 and 8. Low BTU content fuel supply pipe 32 and associated attachment flange 34 may be attached by welds 36 as shown in FIG. 9, or by other suitable attachment means, including the use of threaded bolts. The upstream or inlet side of the combustor housing 10 is designed such that has a large area available for attachment of multiple fuel supply pipes, as shown in FIG. 9 and is particularly desirable when using very low BTU content fuels, such as blast furnace gases.

Combustor housing 10 further includes a peripheral sidewall 20 joining the inlet cover plate 12 and the outlet cover plate 16. Peripheral sidewall 20 may have any suitable size and shape. In the embodiments shown herein, peripheral sidewall 20 has a generally cylindrical shape, with the range of diameters and thicknesses described herein. The thickness of sidewall 20 will be selected to accommodate the pressures associated with the flow of low BTU content fuel gases into the combustor housing 10, as described herein, but generally will be about 3 to 8 inches. In the embodiment shown in FIGS. 3, 7-10, peripheral sidewall 20 is integrally formed with inlet cover plate 12, and as noted above, may be formed by any suitable manufacturing process, including machining or grinding.

Peripheral sidewall 20 encloses a plenum 38 or cavity. Plenum 38 may have any suitable size or shape. In the embodiments shown herein, plenum 38 includes a generally cylindrical or bowl shaped cavity. The peripheral fuel inlet 30 or inlets, open into the inlet side 37 of the plenum 38 (see FIG. 7). At least one radially-spaced, peripheral fuel outlet 40 opens outwardly away from plenum 38 on the combustion side 41 of the plenum 38 toward the combustion chamber (not shown), and a plurality of peripheral fuel outlets 40 may be used, depending on the design requirements, particularly the energy output required from the combustor. The plenum 38 is designed to provide an enlarged flow area upstream of the combustion chamber to create a low flow velocity of the large quantities of very low BTU content fuel and to reduce the pressure loss at the combustor. In the embodiment of FIGS. 1-3, the plenum 38 is generally cylindrical with a diameter of about 25 inches, and a depth or thickness in the radially outward portion of the plenum where it is most open of about 3 inches. Opposite the inlet cover plate 12, plenum 38 and peripheral sidewall 20 define an opening 39 that is configured to receive outlet cover plate 16. Opening 39 has a generally cylindrical shape and a diameter in the range of 15 to 20 inches, and more particularly 18 inches.

As shown in FIGS. 1-3, inlet cover plate 12 also includes a plurality of protruding lugs 42 that protrude into plenum 38 toward the outlet cover plate 16. The protruding lugs 42 may be located on a raised portion 44 of inlet cover plate 12, as shown in FIGS. 1-3. Raised portion 44 provides enhanced strength and stiffness to the center of inlet cover plate 12 where radially-spaced, peripheral protruding lugs 42 are located. In the embodiment of FIGS. 1-3, raised portion 44 has a diameter of about 2 to 5 inches and projects into the plenum 38 about 2 inches. Protruding lugs 42 may have any suitable width, height and shape and any number many be included. In the embodiment of FIGS. 1-3, there are six protruding lugs 42. They have a tapered cylindrical base 46 and a generally cylindrical upper portion 48 having a diameter of about 1 to 2 inches and a height above the surface of raised portion 44 of about 1 inch, such that they extend substantially entirely across raised portion 44. Any suitable number and pattern of protruding lugs 42 may be used, depending on the particular design requirements for combustor housing 10. In the embodiments illustrated herein, there are a total of six protruding lugs 42. Protruding lugs 42 may be identical or different in either of their size, shape or function. In the embodiment of FIGS. 1-3, there is a central protruding lug 50 or indexing lug that is different from protruding lugs 42. Central protruding lug 50 has a height that is greater than the other protruding lugs 42 and it is configured to provide an indexing function for the outlet cover plate 16 through cooperation with a central index hole 52 located therein. Lug 50 and index hole 52 position outlet cover plate 16 within opening 39, and also indexes the radial alignment of the protruding lugs 42 and fuel outlets 40. For example, by rotating outlet cover plate 16 about lug 50, the center of cylindrical fuel outlets 40 may be aligned with the center of protruding lugs 42, such that they are concentrically arranged about longitudinal axis 43 (FIG. 3). Central protruding lug 50 is configured to extend through central indexing hole proximate the outer surface of outlet cover plate 16. In the embodiment of FIGS. 1-3, the other protruding lugs include radially-spaced, peripheral protruding lugs 42. They are radially spaced for concentric axial alignment with radially-spaced, peripheral fuel outlets 40. The number of protruding lugs 42 will preferably correspond to the number of fuel outlets 40. In the embodiment of FIGS. 1-3, passageways 54 extend through radially-spaced, peripheral protruding lugs 42, raised portion 44 and inlet cover plate 12. Passageways 54 may have any suitable shape and size, including the axially-aligned cylindrical bores shown that are concentric with fuel outlets 40. Passageways 54 are configured to receive a fuel conduit 56 for a source of high energy content fuel, such as diesel fuel, used for ignition of the combustor and the low BTU content fuel. Referring to FIG. 8, the fuel supply conduit 56 may be configured to receive a fuel injector 58 for the controlled release of the high energy content fuel which is in turn connected to a fuel line 60 supplied by a high BTU content fuel supply pipe 62. Referring again to FIG. 8, where the high BTU content fuel is diesel fuel, passageway 54 may also include an air supply conduit 64 to supply necessary combustion air for combination with and ignition of the diesel fuel. The air supply conduit 64 is configured for receipt of air from at least one radially-spaced conduit 66 that extends away from central inlet 22. Conduit 66 opens to central inlet 22 on one end, which in turn is configured for attachment to supply pipe 24 (FIGS. 7 and 8), and which in this embodiment is an air supply pipe. On another end, conduit or conduits 66 open into passageway 54 and are configured for fluid coupling to air supply conduit 64. This may also include a plurality of air supply conduits 64 and a corresponding plurality of radially-spaced fuel conduits 56 in any number, with the number preferably selected to correspond to the number of fuel outlets 40. The fuel conduits 56 are preferably located within and spaced from supply conduit 64, such that the outer surface of fuel conduit 56 and the inner surface of air supply conduit 64 define a space through which air may be supplied from conduit 66. In a preferred arrangement, fuel conduit 56 is cylindrical and is concentrically arranged within air supply conduit 64, such that an annular space is provided along the length of these conduits for the passage of air through the space to the firing end. The air supply path and the high energy content fuel path described preferably include sealed joints at the various connections described herein. Passageways 54 may be formed by any suitable manufacturing method, including drilling.

Alternately, as shown in the embodiment of FIG. 9, the protruding lugs 42 may include a passageway 54, or a plurality of passageways 54, that extends only partially through the thickness of protruding lug 42 away from plenum 38 so as to intersect and fluidly couple radially spaced conduit 66. Passageway 54 in this arrangement is configured to receive a fuel supply conduit (not shown). The fuel supply conduit in this arrangement may also include a fuel injector or other gas metering or valving device (not shown), such as a gas valve. This configuration may be used, for example, where the central inlet 22 is configured to receive a high energy content fuel such as natural gas and it is not necessary to supply air through inlet cover plate 12.

Combustor housing 10 also includes outlet cover plate 16 on the outlet side 18 having at least one radially-spaced, peripheral fuel outlet 40. Outlet cover plate 16 may have any suitable shape or size, and may be formed from any suitable high temperature material, including materials that are different from those used for peripheral sidewall 20 and inlet cover plate 12. In particular, outlet cover plate 16 may be formed from a material suitable for use at higher temperatures than those of sidewall 20 and inlet cover plate 12, since it is located in closer proximity to the combustion chamber and exposed to higher temperatures. It may be made using any suitable material adapted to perform at operating temperatures of up to about 600° C., including various grades of steel, such as stainless steels, as well as various, Ni-based, Fe-based, Co-based and other high temperature metal alloys and materials. In the embodiment of FIGS. 1-3, outlet cover plate 16 is cylindrical having a diameter of between about 15 to 25 inches, and more particularly about 22 inches, and a thickness of about 0.5 inches. Forming of the outlet cover plate 16 may be performed using any suitable manufacturing method, including the use of machining, grinding and the like. Outlet cover plate 16 is configured for fixed attachment to sidewall 20 so as to cover and enclose plenum 38. Referring to FIGS. 1-3, outlet cover plate 16 is sized for close spaced engagement within opening 39, with the outlet surface 21 of sidewall 20 proximate opening 39 and the outer surface of outlet cover plate 16 are substantially flush with one another. This positioning may be affected by the use of index lug 50 and index hole 52. Further, index lug 50 may have a tapered base, and the height of the taper may be controlled to also index the vertical position of outlet cover plate 16 by limiting the depth to which the plate may be inserted into plenum 39. Further, indexing may be accomplished by providing corresponding flanges, such as sidewall flange 45 and outlet cover flange 47, as illustrated in FIGS. 1 and 3. Once the outlet cover plate 16 has been placed into opening 39 in the manner described, it is fixed to peripheral sidewall 20, such as by welding or another suitable metal joining process.

Outlet 40 may have any suitable shape or size, and may include a plurality of fuel outlets 40. More particularly, outlet 40 may have the form of a cylindrical outlet bore having a bore diameter, by way of a non-limiting example, of about 1 to 3 inches. Further, in the exemplary embodiment of FIGS. 1-3, there are six outlets 40. Radially spaced outlet 40, or a plurality of fuel outlets 40, is configured to receive a supply of low BTU content fuel gas from the plenum 38 as well as a supply of a high BTU content fuel from a high BTU content fuel conduit, as further described herein. Outlet 40, or fuel outlets 40, may also be adapted to receive air through an air conduit, as further described herein. Referring to FIGS. 1-3, protruding lug 42 is positioned proximate to or within the inlet side of outlet 40 so as to form a restriction which limits the flow of the low BTU content fuel through outlet 40 by defining a channel 68 or annular space between them through which the gaseous fuel exiting outlet 40 must flow. This spacing may be designed in conjunction with consideration of the various fuel inputs into plenum 38 to provide the desired flow characteristics (e.g., flow rate) through outlet 40. Outlet 40 may also include an outlet flange 49 which may be used to seat a nozzle, as described herein.

Referring to FIG. 8, a combustor 100 includes combustor housing 10. Combustor 100 also includes at least one fuel nozzle 70 disposed on outlet cover plate 16 proximate outlet 40. The low BTU content fuel flowing out of outlet 40 flows through nozzle 70 and into the combustion chamber (not shown). Fuel nozzle 70 is generally cylindrical, and adapted to control the flow of fuel into the combustion chamber, including the fuel flow pattern as the fuel exits the nozzle 70. Fuel nozzle 70 has a housing end 72 with an inlet opening 74. Fuel nozzle 70 may be flush mounted on the outer surface of outlet cover plate 16 with inlet opening 74 disposed around outlet 40. Alternately, housing end 72 may be adapted for insertion into outlet 40 and include a mounting flange 76 that controls the depth to which housing end 72 is inserted by abutting engagement with outlet flange 49. In this arrangement, housing end 72 of nozzle 70 also serves to affect the channel 68 between the inlet opening 74 of nozzle proximate housing end 72 and the outer end of protruding lug 42. Nozzle 70 may be disposed on outlet cover plate 16 by any suitable means of attachment, including welding, such as by use of a circumferential weld. An ignition source such as a spark igniter, including a spark plug, may be positioned proximate nozzle 70 for ignition of the fuel exiting the nozzle into the combustion chamber (not shown). Nozzle or nozzles 70 have a generally cylindrical nozzle bore 77 and a nozzle end 78. Nozzle end 78 may include a restriction 80 that is used to control the flow of the low BTU content fuel through the nozzle 70.

As shown in FIG. 8, both the high BTU content fuel conduit 56 and air supply conduit 64, in the form of a fuel injector, extend axially away from outlet cover plate 16 toward nozzle end 78. Particularly, fuel injector 58 may extend within nozzle bore 77 to a position proximate restriction 80. The radial spacing 82 between restriction 80 and fuel injector 58 defines a outlet spacing or channel 82 through which the low BTU content fuel must pass in order to exit nozzle 70 and combustor housing 10. This outlet spacing 82 defines a nozzle orifice to control the flow of fuel from the nozzle. Spacing 82 may be designed to achieve the desired flow characteristics from the combustor, and may be an annular spacing or channel as shown in FIG. 8. The spacing 82 is an unobstructed 360° flow path or channel. Such a flow path is desirable because it maintains a uniform flow pattern of the fuel exiting the nozzle and eliminates restrictions in the flow path in the space between the injector and nozzle bore along the length of the nozzle.

Figure 4:
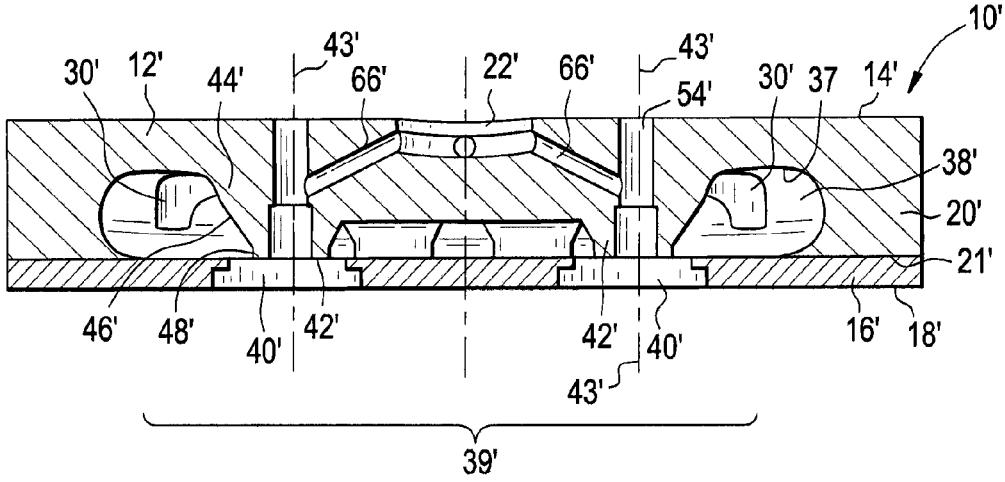
FIG. 4 is a cross-sectional view of a second exemplary embodiment of a combustor housing as disclosed herein.

A second exemplary embodiment of a combustor housing 10' is illustrated in FIG. 4. This embodiment includes the same elements as discussed above with respect to the embodiment of FIG. 3 in a somewhat different configuration, with the changes discussed further below. In the embodiment of FIG. 4, the outlet cover plate 16' has a larger size, such as a larger diameter such that it extends at least partially, and more preferably fully, across the outlet surface of sidewall 20', rather than being inserted into opening 39'. As compared to the embodiment of FIG. 3, the thickness of the sidewall 20' may be somewhat thinner so that the protruding lugs 42' are located with respect to the fuel outlets 40', as described herein. The central lug 50 of FIG. 3 is not required in this embodiment hence, central lug 50 may be omitted, thereby opening up the central portion of plenum 38' and providing more usable volume within plenum 38'. Alternately, central lug 50 may be replaced with a central protruding lug 42' (not shown) and corresponding nozzle 70 (not shown), such that a central outlet (not shown) may also be incorporated into outlet cover plate 16'. Outlet cover plate 16' may be attached to peripheral sidewall 20' by any suitable attachment means, such as a plurality of radially-spaced threaded bolts, or a circumferential weld, or the like. Likewise, combustor housing 10' may be made from the same materials as those described for combustor housing 10 of FIG. 3, and may incorporate various pipes, flanges, nozzles, fuel conduits, fuel injectors and other components of the types and in the manner described with reference to combustor housing 10' to form a combustor.

Figure 5:
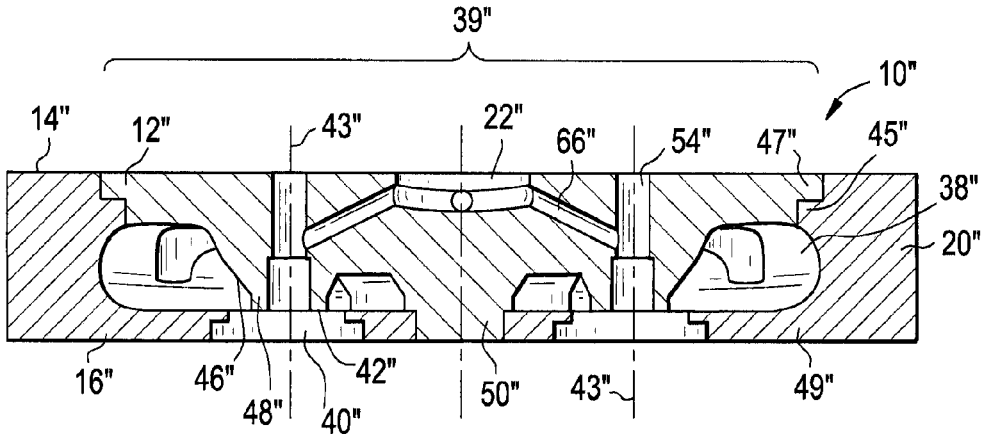
FIG. 5 is a cross-sectional view of a third exemplary embodiment of a combustor housing as disclosed herein.

A third exemplary embodiment of a combustor housing 10" is illustrated in FIG. 5. This embodiment includes the same elements as discussed above with respect to the embodiment of FIG. 3 in a somewhat different configuration, with the changes discussed further below. In the embodiment of FIG. 5, the outlet cover plate 16" and fuel outlets 40" are formed integrally with sidewall 20". It is believed that this arrangement may provide greater structural rigidity to the combustion side of combustor housing during operation of the combustor and turbine, and removes any possibility of failures or other performance issues associated with the attachment means, such as a weld, used to attach the outlet cover plate 16 in the embodiment of FIG. 3 during operation. Sidewall 20" will similarly be altered to provide an opening 39" similar in size to that of opening 39 of FIG. 3, but located on the opposite end of sidewall 20". In the embodiment of FIG. 5, the inlet cover plate 12" is manufactured as a separate component and attached to sidewall 20" as shown. Otherwise, inlet cover plate 12" may include all of the other features included in inlet cover plate 12 of FIG. 3, such as protruding lugs 42" raised portion 44", central protruding lug 50", radially-spaced, peripheral fuel inlets 30", central inlet 22" and the various conduits and passageways described therein. Inlet cover plate 12" may be inserted into opening 39" and attached in a manner analogous to that described with regard to outlet cover plate 16 of FIG. 3. Likewise, combustor housing 10' may be made from the same materials as those described for combustor housing 10, and may incorporate various pipes, flanges, nozzles, fuel conduits, fuel injectors and other components of the types and in the manner described with reference to combustor housing 10'.

Figure 6:
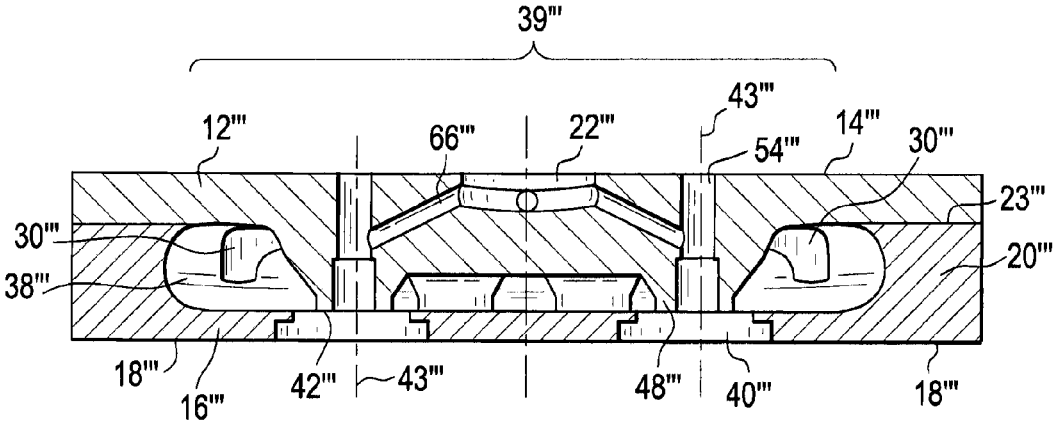
FIG. 6 is a cross-sectional view of a fourth exemplary embodiment of a combustor housing as disclosed herein.

A fourth exemplary embodiment of a combustor housing 10'" is illustrated in FIG. 6. This embodiment includes the same elements as discussed above with respect to the embodiment of FIG. 5 in a somewhat different configuration, with the changes discussed further below. In the embodiment of FIG. 6, the inlet cover plate 12'" has a larger size, such as a larger diameter such that it extends at least partially, and more preferably fully, across the inlet surface 23'" of sidewall 20'" rather than being inserted into opening 39'". The central lug 50" is not required in this embodiment hence, central lug 50" of FIG. 5 may be omitted, thereby opening up the central portion of plenum 38'" and providing more usable volume within plenum 38'". Alternately, central lug 50" of the embodiment of FIG. 5 may be replaced with a central protruding lug 42'" (not shown), such that a central outlet (not shown) and associated nozzle (not shown) may also be incorporated into outlet cover plate 16'". Inlet cover plate 12'" may be attached to peripheral sidewall 20'" by any suitable attachment means, such as a plurality of radially-spaced threaded bolts, or a circumferential weld, or the like.

Figure 11:
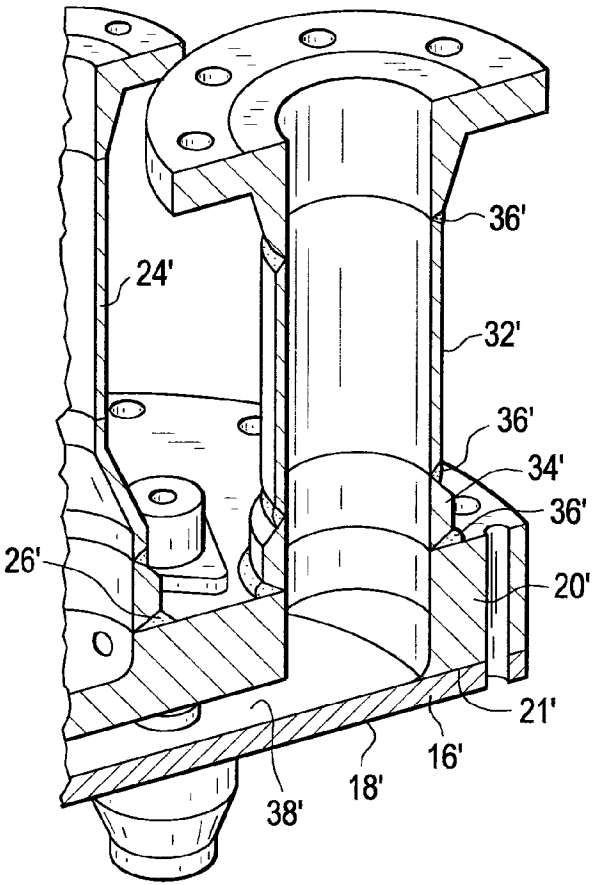
FIG. 11 is a perspective cross-sectional view of a second exemplary embodiment of an inlet and associated flanges and piping as disclosed herein.
Figure 10:
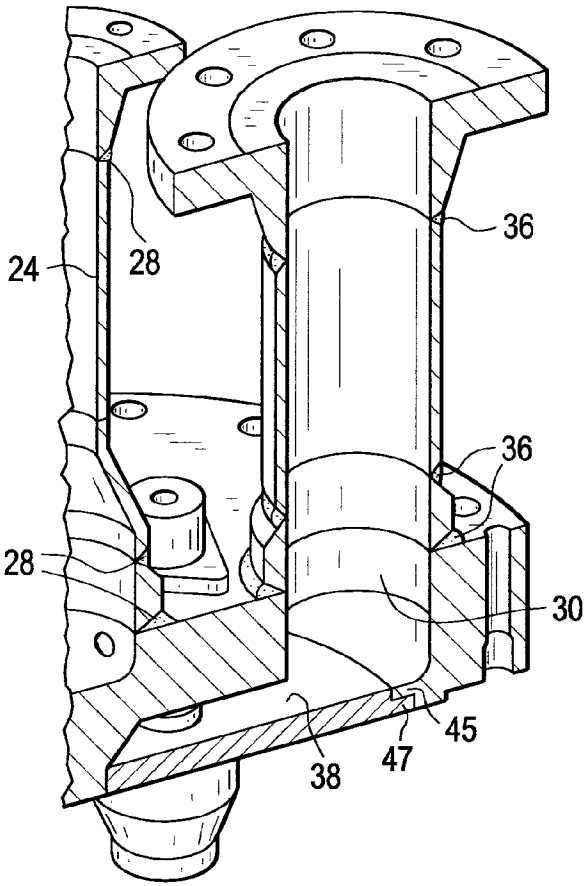
FIG. 10 is a perspective cross-sectional view of an exemplary embodiment of an inlet and associated flanges and piping as disclosed herein.

FIG. 10 illustrates fuel inlet 30 of FIG. 3 as it opens into plenum 38. The mixing area created by plenum 38 advantageously affords a large volume for receipt of the substantial volumetric input of low BTU content fuel gas at high flow rates from multiple fuel inlets 30. This arrangement is particularly advantageous in that is affords a low pressure drop per individual fuel inlet 30, and thus a low total pressure drop associated with the sum of all of the fuel inlets 30. FIG. 11 illustrates the inlet arrangement associated with fuel inlet 30' as shown in FIG. 4. In this embodiment, outlet cover plate 16' covers the entire outlet surface 21' of sidewall 20'. This inlet configuration is advantageous because the center portion of plenum 38' is open due to the absence of a central lug which provides a more open configuration of the center portion of plenum 38' for better mixing and a larger plenum 38' volume as compared, for example, to plenum 38. Further, it permits outlet cover plate 16' to be bolted to the peripheral sidewall 20' using a plurality of threaded bolts or similar fasteners. The elimination of the central lug and bolted attachment provides another advantage of this embodiment, namely the elimination of two welds, including the weld associated with the center lug, and the weld used to attach outer cover plate to peripheral sidewall, thereby reducing cost and complexity.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A combustor housing, comprising:

an inlet cover plate having a central inlet configured to receive a supply of one of a high BTU content fuel or air and a plurality of radially-spaced, peripheral fuel inlets configured to receive a supply of low BTU content fuel;

an outlet cover plate having a plurality of radially-spaced, peripheral fuel outlets; and a peripheral sidewall joining the inlet cover and the outlet cover and enclosing a plenum, the at least one peripheral fuel inlet opening through the inlet cover plate into the plenum and the at least one fuel outlet opening from the plenum through the outlet cover plate, the central inlet opening into a plurality of radially spaced conduits which extend away from the central inlet and open into respective ones of a plurality of high BTU content fuel conduits or air supply conduits that are axially aligned with the corresponding outlets.

2. A combustor housing, comprising:

an inlet cover plate having a central inlet configured to receive a supply of one of a high BTU content fuel or air and at least one radially-spaced, peripheral fuel inlet configured to receive a supply of low BTU content fuel;

an outlet cover plate having at least one radially-spaced, peripheral fuel outlet;

a peripheral sidewall joining the inlet cover and the outlet cover and enclosing a plenum, the at least one peripheral fuel inlet opening through the inlet cover plate into the plenum and the at least one fuel outlet opening from the plenum through the outlet cover plate, the central inlet opening into at least one conduit which extends away form the central inlet and opens into at least one high BTU content fuel conduit or air supply conduit that is axially aligned with the at least one fuel outlet; and a plurality of radially-spaced protruding lugs extending from the inlet cover plate into the plenum and axially aligned with and proximate to the plurality of outlets, the plurality of the high BTU content fuel conduits or the air supply conduits disposed in the protruding lugs.

3. The combustor housing of claim 2, wherein the central inlet is configured to receive a high BTU content fuel, and the plurality of radially spaced conduits open into a respective plurality of high BTU content fuel conduits.

4. The combustor housing of claim 3, wherein the high BTU content fuel conduits are each spaced from and extend axially through respective outlets creating a 360° spacing between them.

5. The combustor housing of claim 4, wherein the high BTU content fuel conduits are concentrically spaced within the respective outlets.

6. The combustor housing of claim 4, further comprising a plurality of nozzles disposed on a side of the outlet cover plate away from the plenum and enclosing the respective outlets and fuel conduits, the nozzles having a respective plurality of nozzle bores and firing ends, the fuel conduits spaced from and extending axially away from the outlet cover plate through the outlets and within the nozzle bores to a respective plurality of injection ends, each injection end having a 360° spacing from the respective firing end within the nozzle bore.

7. The combustor housing of claim 2, wherein the central inlet is configured to receive air, and the plurality of radially spaced conduits open into a respective plurality of air conduits, and wherein a respective plurality of high BTU fuel conduits are also disposed in the protruding lugs extending through the inlet cover plate and axially within the air conduits.

8. The combustor housing of claim 7, wherein the fuel conduits and air conduits are each spaced from and extend axially through respective outlets creating a 360° spacing between them.

9. The combustor housing of claim 8, wherein the fuel conduits and air conduits are concentrically spaced within the respective outlets.

10. The combustor housing of claim 8, further comprising a plurality of nozzles disposed on a side of the outlet cover plate away from the plenum and enclosing the respective outlets, the nozzles having a respective plurality of nozzle bores and firing ends, the fuel conduits and air conduits are radially spaced from and extending axially away from the outlet cover plate through the outlets and within the nozzle bores to a respective plurality of injection ends, each injection end having a 360° spacing from the respective firing ends within the nozzle bore.

11. A combustor housing, comprising:

an inlet cover plate having a central inlet configured to receive a supply of one of a high BTU content fuel or air and at least one radially-spaced, peripheral fuel inlet configured to receive a supply of low BTU content fuel;

an outlet cover plate having at least one radially-spaced, peripheral fuel outlet; and a peripheral sidewall joining the inlet cover and the outlet cover and enclosing a plenum, the at least one peripheral fuel inlet opening through the inlet cover plate into the plenum and the at least one fuel outlet opening from the plenum through the outlet cover plate, the central inlet opening into at least one conduit which extends away form the central inlet and opens into at least one high BTU content fuel conduit or air supply conduit that is axially aligned with the at least one fuel outlet, wherein the inlet cover plate is integral with the sidewall and the plenum and the outlet plate is attached within an opening in the sidewall opposite the inlet cover plate, and wherein the inlet cover plate further comprises an indexing protrusion and outlet cover plate further comprises an indexing hole, wherein the outlet cover plate is indexed to the inlet cover plate by location of the indexing protrusion within the indexing hole.

* * * * *